US006023831A

United States Patent [19]

Stinnertz

[11] Patent Number: 6,023,831

[45] Date of Patent: Feb. 15, 2000

[54] PROCESS FOR PRODUCING METAL-SHEATHED STRANDS, ESPECIALLY GLASS FIBER CABLES

[75] Inventor: Horst Stinnertz, Willich, Germany

[73] Assignee: Mannesmann Aktiengesellschaft, Düsseldorf, Germany

[21] Appl. No.: 09/033,061

[22] Filed: Feb. 27, 1998

[30] Foreign Application Priority Data

Mar. 24, 1997 [DE] Germany ..... 197 14 305

[51] Int. Cl.[7] ..... B23P 17/00

[52] U.S. Cl. ..... 29/419.1; 29/33 R; 29/599; 228/148

[58] Field of Search ..... 29/599, 33 R, 29/419; 228/148

[56] References Cited

U.S. PATENT DOCUMENTS 3,913,368 10/1975 Eibe ..... 72/234
5,249,731 10/1993 Ziemek ..... 228/148

FOREIGN PATENT DOCUMENTS 19 43 826 3/1971 Germany .

*Primary Examiner*—P. W. Echols
*Assistant Examiner*—John C. Hong
*Attorney, Agent, or Firm*—Cohen, Pontani, Lieberman & Pavane

[57] ABSTRACT

Disclosed is a process and apparatus for producing metal-sheathed strands, especially glass fiber cables, from a metal strip that is first formed into a U-shaped profile and then, after the placement therein of a non-ductile or slightly ductile core material, is closed to form a split tube carrying and/or protecting the core material, which split tube, after the welding of its longitudinal seam, is reduced in a subsequent deformation step. In the process of the invention, the metal-sheathed strand with the welded longitudinal seam is cold-formed in a stretch-reducing fashion in multiple continuous sequential steps. In the apparatus for implementing the process, multiple speed-controlled roll stands of a stretch-reducing cold rolling mill with declining caliber cross-sections are arranged one behind the other directly after the longitudinal seam welding machine for the split tube for the reductive deformation of the metal sheath.

8 Claims, 1 Drawing Sheet

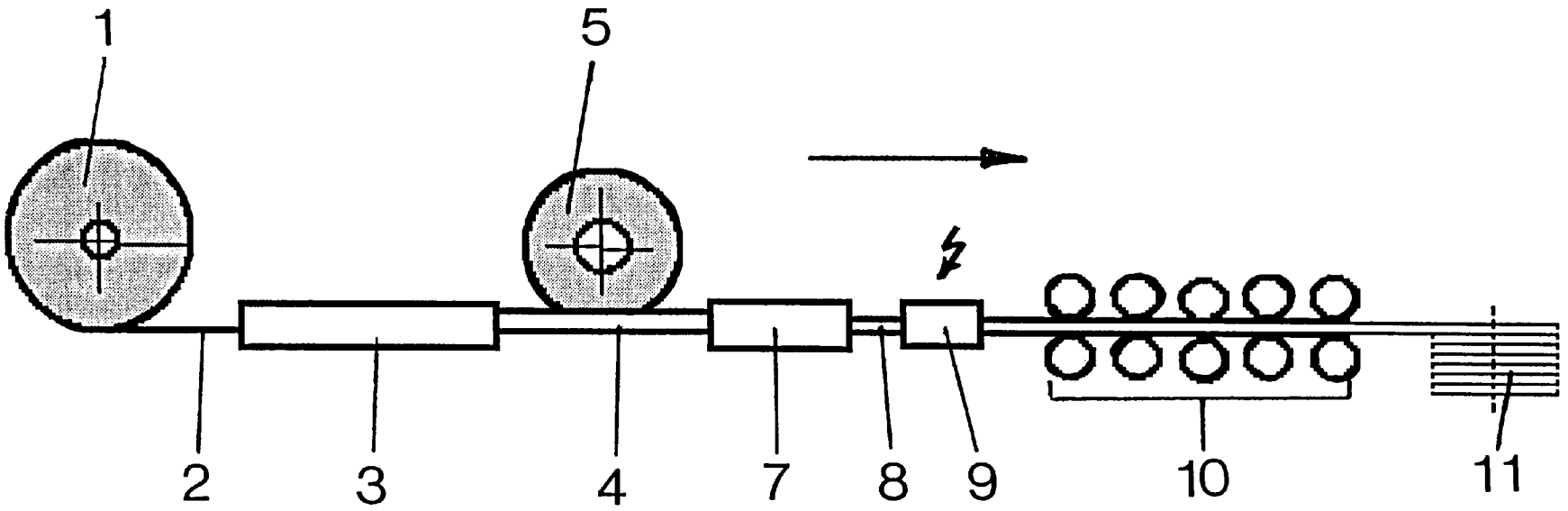
1
2
3
4
5
7
8
9
10
11

PROCESS FOR PRODUCING METAL-SHEATHED STRANDS, ESPECIALLY GLASS FIBER CABLES

BACKGROUND OF THE INVENTION

The invention relates to a process for producing metal-sheathed strands, especially glass fiber cables, in which non-ductile or slightly ductile core material is placed in a profile consisting of a metal strip formed into a U-shaped cross-section which is then closed, so as to form a split tube carrying and/or protecting the core material. The split tube is subjected, after the welding of its longitudinal seam, to reductive processing.

Non-ductile and slightly ductile fibers, wires, and metal and non-metal tubes are sheathed in quasi-endless lengths by closed metal protective and carrying tubes to improve their use characteristics. Typical areas of application for the present invention are the sheathing of glass fibers used in telecommunications, particularly by steel sheaths, and the insertion of filaments in superconductors.

In a known process for producing metal-sheathed strands, a strip, e.g., a steel strip is formed into a U-shaped cross-section into which glass fibers suitable for data transmission are placed along with a gel as a lubricant and protective agent. The glass fibers are unwound from a coil and placed in practically continuous fashion into the strip, which is continuously unwound from a reel and formed into the U-shaped profile. After the glass fiber core material has been inserted, the U-shaped profile is shaped into a split tube. The remaining longitudinal seam is then closed by welding, and the formed tube is subjected to hollow drawing in a continuous drawing device.

A disadvantage of the known process is that it limits the possible reduction of the strand sheath to approximately 25%. A second drawing step in a downstream drawing machine is not possible, because, in the case of virtually endless cables, lengthening the drawn tube would tear the only slightly deformable fibers. In addition, hollow drawing results in thicker walls, so that the wall to be welded must be thinner than the finished wall. The relatively small welding sizes impair the productivity and profitability of the production process in the known unit. Furthermore, shaping the strip and inserting the core material are difficult in the case of relatively thin and narrow initial strips.

An object of the present invention is to provide a process and an apparatus for producing metal-sheathed strands which have the capability of greater stretching of the tube with the welded longitudinal seam, and which operate more economically with higher production rates and lower production costs.

SUMMARY OF THE INVENTION

The object of the invention is achieved by a process wherein the longitudinally-welded metal-sheathed strand is cold-worked in a stretch-reducing manner in multiple continuously sequential steps.

In one aspect of the process of the invention, the known drawing process is replaced with a stretch-reducing cold-rolling process. The latter process, which is known in itself, permits greater stretching of the longitudinally-welded tube in multiple steps. Due to the greater possible stretching, a substantially greater wall thickness can be selected for the split tube. Due to the workability of the thicker strip as well as the easier insertion of core material into the U-shaped profile because of the greater strip width, the production rate of the machine can be increased. The capability of greater stretching also allows the number of different welding sizes to be reduced, because by changing the stretch, i.e., the number of deformation steps (number of stands), any desired size can be presented.

Because of the greater initial diameter of the tube with the welded longitudinal seam, the invention also permits a greater distance to be selected between the core material and the welding area, thus preventing damage to the core material during welding. Moreover, the greater deformation allows the strength of the tube to be increased, even in the welded seam area.

In one aspect of the invention, a reduction in wall thickness can be carried out at the same time as the reduction in diameter by means of cold deformation under controlled tension.

In apparatus for producing metal-sheathed strands, for the reductive deformation of the metal sheath, multiple speed-controlled roll stands of a stretch-reducing cold rolling mill with declining caliber cross-sections are arranged one behind the other directly after the longitudinal seam welding apparatus for the split tube. According to one embodiment of the invention, the individual stands of the stretch-reducing cold rolling mill can be speed-controlled so as to apply longitudinal tensile forces to the metal sheath of the strand, resulting in a wall reduction.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWING

The drawing schematically shows an apparatus of the invention for practicing the inventive process.

DESCRIPTION OF THE PREFERRED EMBODIMENT

Referring to the drawing, a strip 2 is continuously unwound from a narrow strip coil 1 and fed to a deformation station 3, where the steel strip is formed into a profile with a U-shaped cross-section. A glass fiber bundle unwound from a coil 5 and, as needed, coated with a gel, is continuously placed into the U-shaped profile 4, as the profiled shape moves continuously through the machine in the direction of the arrow. In the deformation station 7, the U-shaped profile is closed to form a split tube 8, whose longitudinal seam is welded in the welding station 9. The longitudinally-welded tube created in this way is introduced directly after the welding station 9 into the multi-stand stretch-reducing cold rolling mill 10, whose roll stands have caliber cross-sections of declining size in the direction of the arrow. In addition, the roll stands are speed-controlled and the speed control is implemented in such a way that tension is applied to the outer tube surface between the individual stands, causing a wall reduction. The split tube with the glass fiber core material, stretched and reduced in diameter as well as in wall thickness, is then wound up at the end of the stretch-reducing cold rolling mill, as indicated by reference number 11.

The following example shows how the present invention increases the production rate of a generic apparatus:

According to the prior art, a welding size, for example, of approximately 6 mm×0.18 mm is necessary for a finished tube of 4 mm outer diameter and 0.2 mm wall thickness. According to the process of the invention, a size of 10 mm×0.25 mm is planned, for example. The associated cross-section is larger by a factor of 2.3 than in the prior art. Thus, given the same welding speed, the production rate for the finished product can be increased by the same factor of 2.3.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

I claim:

1. A process for producing a metal-sheathed strand, comprising:

forming a U-shaped cross-section from a metal strip;

placing in said metal strip a nonductile or slightly ductile core material;

closing the metal strip to form a split tube carrying and/or protecting the core material and having a longitudinal seam;

welding the closed tube along the longitudinal seam; and then cold working the metal-sheathed strand with the welded longitudinal seam in a stretch-reducing fashion in multiple continuously sequential steps.

2. The process of claim 1 wherein the cold working is carried out under controlled tension.

3. An apparatus for producing a metal-sheathed strand, from a metal strip that is first formed into a profile with a U-shaped cross-section and, after the placement therein of a non-ductile or slightly ductile core material, is then closed to form a split tube carrying and/or protecting the core material, which split tube, after the welding of its longitudinal seam, is processed reductively in a subsequent deformation step, comprising:

a welding machine for welding the longitudinal seam of the split tube; and a stretch-reducing cold roll mill with multiple speed-controlled roll stands having declining caliber cross-sections and roll stands arranged one behind the other directly for the reductive deformation of the metal sheath.

4. The apparatus of claim 3 wherein the individual stands of the stretch-reducing cold rolling mill are speed-controlled to apply longitudinal tensile forces, which cause a wall reduction, to the metal sheath of the strand.

5. A system for producing metal sheathed strands, comprising:

a roll for providing a strip;

a deforming device for processing the strip to form a profiled strip;

a roller for providing a core and depositing the same in the profiled strip;

a second deforming device to close the profiled strip into a split tube;

a weld station for welding the split tube along a longitudinal seam; and a stretch reducing cold roll mill for the reductive deformation of the welded split tube.

6. A process of claim 1, wherein the metal-sheathed strand is a glass fiber cable.

7. A method for producing a metal-sheathed strand comprising:

inserting a core material, which is not ductile or only slightly ductile in a profile shaped from a metal strip to form a U-shaped cross section;

closing the metal strip to form a split tube which bears and supports the core material;

welding a longitudinal seam of the tube and subsequently machining the tube in a reducing fashion, wherein the metal-sheathed strand with welded longitudinal seam is cold-rolled in a stretch-reducing fashion in a plurality of continuously successive steps, and the cold rolling is performed under controlled tension.

8. The method of claim 7 wherein the core material is glass fibers.

* * * * *